US005200620A

United States Patent [19]

Peritt et al.

[11] Patent Number: 5,200,620

[45] Date of Patent: Apr. 6, 1993

[54] ELECTROSTATIC FIBER SPREADER INCLUDING A CORONA DISCHARGE DEVICE

[75] Inventors: Jonathan M. Peritt; Richard Everett; Alan Edelstein, all of Alexandria, Va.

[73] Assignee: The United States of America as represented by the Secretary of the Navy, Washington, D.C.

[21] Appl. No.: 788,018

[22] Filed: Nov. 5, 1991

[51] Int. Cl.[5] ..... H01T 19/00

[52] U.S. Cl. ..... 250/324; 250/325; 361/233, 234, 225; 264/22; 425/174.8 R, 174.8 E

[58] Field of Search ..... 250/324, 325, 326; 361/233, 234, 225; 264/22; 425/174.8 R, 174 E

[56] References Cited

U.S. PATENT DOCUMENTS

| | | | |
|---|---|---|---|
| 3,456,156 | 7/1969 | Kilby | 250/325 |
| 3,967,118 | 6/1976 | Sternberg | 250/325 |
| 4,081,856 | 3/1978 | Sternberg | 361/225 |
| 4,537,733 | 8/1985 | Farago | 425/174.8 E |
| 4,666,396 | 5/1987 | Shah | 425/174.8 E |
| 4,999,733 | 3/1991 | Kakuda | 361/213 |

*Primary Examiner*—Jack I. Berman
*Assistant Examiner*—Jim Beyer
*Attorney, Agent, or Firm*—Thomas E. McDonnell; Barry A. Edelberg

[57] ABSTRACT

A fiber spreader is provided which reduces fiber damage that occurs during spreading. The fiber spreader includes a thin electrically grounded support sheet for supporting a layer of fibers on one surface thereof. The fibers supported on the support sheet are guided by a plurality of guide rollers past at least one corona discharge region at which the fibers are spread substantially uniformly. A motor driven spool advances the support sheet past the corona discharge region. The fibers are attached to the support sheet by an electrostatic attraction. The guide rollers are positioned so as to provide at least one region in which the sheet and the fibers are physically separated to allow for the uniform spreading of the fibers. After the fibers are spread, the fibers and the support sheet are united again and collected on a motor-driven spool.

20 Claims, 1 Drawing Sheet

ELECTROSTATIC FIBER SPREADER INCLUDING A CORONA DISCHARGE DEVICE

FIELD OF THE INVENTION

This invention relates generally to the manufacturing of small diameter fiber reinforced metal composites and more specifically, to a corona discharge device for uniformly spreading fibers used therein.

BACKGROUND OF THE INVENTION

The manufacture of small diameter fiber reinforced metal matrix composites by any method except casting and liquid metal infiltration of wires requires uniformly spread fibers. Both nonconductive and conductive fibers have been spread mechanically, pneumatically and triboelectrically. Mechanical fiber spreaders, using physical contact, cause abrasion damage and breakage of small diameter brittle fibers and are thus not optimal in manufacturing the above composites. There are additional problems associated with nonconductive fibers. Nonconductive fibers tend to become electrically charged by rubbing with parts of the spreader or possibly by passing though the flow of gas in a pneumatic spreader. The phenomenon of charge transfer via moving contact is known as triboelectricity and is generally a hinderance in the spreading of nonconductive fibers mechanically or pneumatically. This charging results in the fibers being attracted to parts of the spreader; and often results in a malfunction of the spreader.

The process of transferring charge to fibers via a corona discharge effect has been used to spread nonconductive fibers. However, in these processes the fibers are commonly forwarded by pneumatic action or the direct application of tension to the fibers. Several patents have attempted to provide solutions to the above problems.

U.S. Pat. Nos. 4,081,856 and 3,967,118 (Sternberg) discloses the use of corona discharge in the spreading of fibers. The fibers are advanced by an air nozzle into a corona discharge region. The use of air to advance the fibers can result in non-uniform spreading and breaking of the fibers.

U.S. Pat. No. 3,456,156 (Kilby et al.) discloses an apparatus for applying an electrostatic charge to fibrous material. A fibrous web is passed through a corona discharge region and is electrically charged therein. The fibers are then deposited upon an oppositely charged moving belt to form a fiber mat. By depositing the fibers on an oppositely charged belt, there will be fibers that stick to the belt after the fiber mat is removed from the belt. This increases the amount of maintenance involved with this apparatus.

U.S. Pat. No. 4,999,733 (Kakuda) discloses an apparatus for reducing the static electricity on the surface of a web. This apparatus has a hollow roller which has holes through its outer surface. Located below these holes are electrodes used in creating a corona discharge. This corona discharge is used to remove electrostatic buildup on a web that is in contact with the roller.

Although all of the above-discussed apparatus relate to the spreading of fibers by corona discharge, they have the various disadvantages mentioned above.

SUMMARY OF THE INVENTION

According to the invention, an improved electrostatic fiber spreader is provided which has the advantage of reducing fiber damage due to all spreading techniques. The improved fiber spreading apparatus utilizes an electrically conductive support sheet or foil which is electrically grounded, and which supports a plurality of fibers in a layer or sheet on one surface thereof. A plurality of rollers is used to guide the support sheet past at least one corona discharge device which is positioned above the support sheet and layer of fibers and which provides substantially uniform spreading of the plurality of fibers. A means, preferably comprising a motor-driven spool, provides advancing of the support sheet past the corona discharge region. The fibers are attached to the support sheet by electrostatic attraction. The guide rollers are positioned so as to provide at least one region in which the sheet and the fibers are physically separated to allow for the uniform spreading of the fibers. After the fibers are spread, the fibers and the thin sheet are united again and collected on a spool.

The improved electrostatic fiber spreader causes a minimal amount of fiber breakage because the fibers are charged using corona discharge and are transported on the grounded support sheet. Tension is only provided to the support sheet and thus any damage to the fibers is reduced or eliminated. As a result of the reduced fiber breakage, a higher quality fiber composite is obtained. Further, the grounded sheet transport is better suited to manufacturing processes with respect to controllability and automatization than conventional pneumatic transports.

Other features and advantages of the invention will be set forth in, or apparent from, the following detailed description of preferred embodiments of the invention.

DESCRIPTION OF THE PREFERRED EMBODIMENTS

Figure 1:
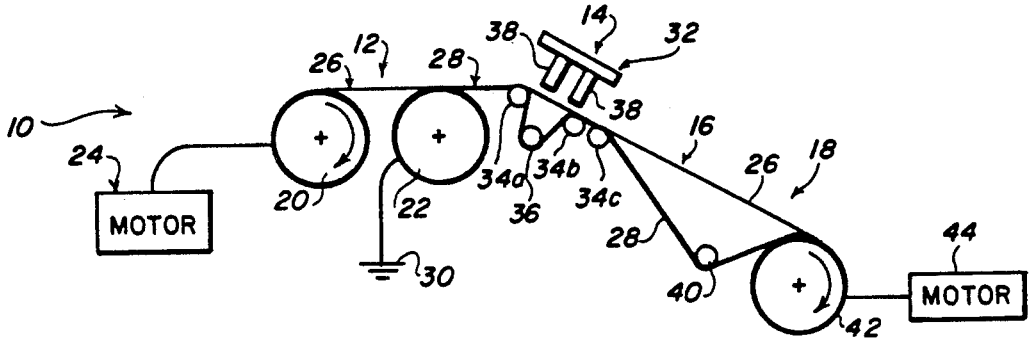
FIG. 1 is a schematic side elevational view of an apparatus for uniformly spreading fibers constructed in accordance with a preferred embodiment of the invention.

Referring to FIG. 1, there is shown a fiber spreader, i.e., an apparatus for uniformly spreading fibers, constructed in accordance with a preferred embodiment of the invention. The fiber spreader, which is generally denoted 10, includes a feed region 12, a corona discharge region 14, a spreading region 16, and a collection region 18. In the feed region 12, there are two spools 20 and 22. A motor 24 is attached to spool 20 to enable spool 20 to rotate. Spool 20 dispenses a fiber tow 26 when spool 20 is rotated by motor 24. The speed at which spool 20 rotates is controlled to minimize fiber tension in tow 26. In an exemplary preferred embodiment, the speed of rotation will be approximately one centimeter per second, although higher speeds may be used without excessive detrimental effects. After being dispensed from spool 20, the fiber tow 26 comes into contact with a thin foil or sheet 28 which is dispensed by spool 22. Spool 22 is a free rolling spool which is rotated by tension that is exerted on sheet 28. In a preferred embodiment, sheet 28 comprises a metallic foil that is electrically connected to ground as indicated at 30. The fiber tow 26 is secured to or caused to adhere to foil 28 by electrostatic attraction between the fiber tow 26 and foil 28. As discussed in more detail below the fiber tow 26 and foil 28 travel synchronously into regions 14, 16, and 18 and this synchronous travel allows foil 28 to bear all of the tension exerted by the fiber spreader 10.

After being secured together the fiber tow 26 and foil 28 enter the corona discharge region 14. In region 14, there is at least one discharge device generally denoted 32, a plurality of support rollers 34a, 34b and 34c, and an adjustment roller 36. The fiber tow 26 and foil 28 are both initially supported by roller 34a. After traveling over roller 34a, foil 28 passes around the underside of adjustment roller 36 and the fiber tow 26 is separated from foil 28. Adjustment roller 36 is preferably adjusted by displacement thereof in a plane perpendicular to that of fiber tow 26. The perpendicular distance between adjustment roller 36 and tow 26 can be varied to control the tension on fiber tow 26. The fiber tow 26 is charged by the corona discharge device 32 and then comes back into contact with foil 28 which engages tow 26 at roller 34b. The use of two rollers 34b and 34c to support tow 26 and sheet 28 is advantageous in that the us of the second roller 34c aids in providing a buildup of the electrostatic force which helps to hold tow 26 and sheet 28 together. Stated differently, roller 34c increases the friction from electrostatic attraction on the fibers, thereby preventing the fiber tow from shearing. The nonconductive fibers in tow 26 do not release their charge to foil 28. This allows the fiber tow 26 to be charged any number of times. The electrostatic attraction between fiber tow 26 and foil 28 prevent the fibers of tow 26 from separating.

The corona discharge device 32 is conventional in nature, and includes at least one row of bars or electrodes 38. The row of electrodes 38 is arranged so as to extend perpendicular to the direction of movement of fiber tow 26. By arranging the row of electrodes 38 perpendicular to tow 26, it is assured that the fibers in tow 26 cannot escape the corona discharge by drifting laterally. The high potential of the row of electrodes 38 prevents the fibers from tow 26 from lifting off sheet 28. If the fibers were allowed to lift off sheet 28, arcing could occur and could result in fiber breakage. The dominant factors affecting the amount of net charge transferred to the fiber tow 26 are the electrical potential, the size of the gap between tow 26 and the row of electrodes 38, relative humidity and gas composition. In experiments to date, typical voltages are between 5 and 15 kW, with 4 to 6 kW being the most common. Experiments have been performed using gaps of 3/16" to ¾". The best results were obtained using gaps of ⅜ to ¼". The process according to the present invention has been successfully demonstrated using air, particularly dry air, and a mixture of $N_2$ and $O_2$. The relative humidity should be sufficiently low (less than about 45%) to prevent arcing. Typically, the relative humidity is maintained in a range of below about 45% down to about 25%. While other gases should work well in the method according to the present invention, atmospheres using only $N_2$ or only Ar have not been successfully used. In a specific exemplary embodiment, a gap of approximately one centimeter and a potential of approximately five kilovolts are used; the distance between the centers of rollers 34a and 34b, measured along the plane of foil 28, is 4 inches; the distance between the centers of rollers 34b and 34c, measured along the plane of foil 28, is 1.25 inches; the center of roller 36 is halfway between the centers of rollers 34a and 34b, as measured along the plane of foil 28; and the centers of rollers 34a and 36 are vertically displaced by a distance of about 7 inches. It should be noted that more than one discharge device 32 can be provided in the corona discharge region 14.

Tow 26 and foil 28 enter the spreading region 16 after leaving the corona discharge region 14. As mentioned earlier, the fibers in tow 26 will not spread as long as they are in contact with foil 28. In spreading region 16, foil 28 is separated from fiber tow 26 by passing sheet 28 under an adjustment roller 40. Adjustment roller 40 may be displaced in a plane perpendicular to the plane of fiber tow 26. By varying the distance or spacing between adjustment roller 36 and fiber tow 26, the tension on fiber tow 26 can be controlled, e.g., by increasing this distance, the fiber tension can be decreased. In specific exemplary embodiment, spread widths of one to six inches have been produced with a tow of 460 brittle alumina fibers 12 to 20 μm in diameter and 4 inches to 50 feet in length. The width of spread is controlled by adjusting the adjustment rollers 36 and 40 and varying the amount of charge produced in the tow by the corona discharge device 32.

After the fibers are spread to the desired width, the fiber tow 26 and foil 28 are once again united in the collection region 18. A spool 42, located in collection region 18, receives both the fiber tow 26 and foil 28 so that the two are wound together. Once again, the fibers are prevented from further spreading by the electrostatic attraction between fiber tow 26 and foil 28. Spool 42 is driven by a motor 44 and in a specific exemplary embodiment, spool 42 is rotated at one centimeter per second and is set at the same speed as spool 20.

Considering the overall operation of the fiber spreading apparatus 10, the fiber tow 26 is brought into contact with grounded foil 28. The electrostatic attraction between tow 26 and foil 28 helps to maintain the relative positions of the two with respect to each other. The fiber tow 26 and foil 28 are then passed under a corona discharge device 32 and at this time, the fiber tow 26 is separated from foil 28. Fiber tow 26 receives an electrical charge from the corona discharge device 32. Fiber tow 26 and foil 28 are then brought together again so that premature spreading of fibers in the fiber tow 26 does not occur. Thereafter the fiber tow 26 and foil 28 are separated to allow for the spreading of fibers in tow 26. After the fibers have spread to the desired width, the fiber tow 26 and foil 28 are reunited and are collected by spool 42. Note that, in this scheme, the fiber tow is spread out only after it has completed passing through the corona discharge device 32 and then once again contacted, and later separated from, the foil 28.

Figure 2:
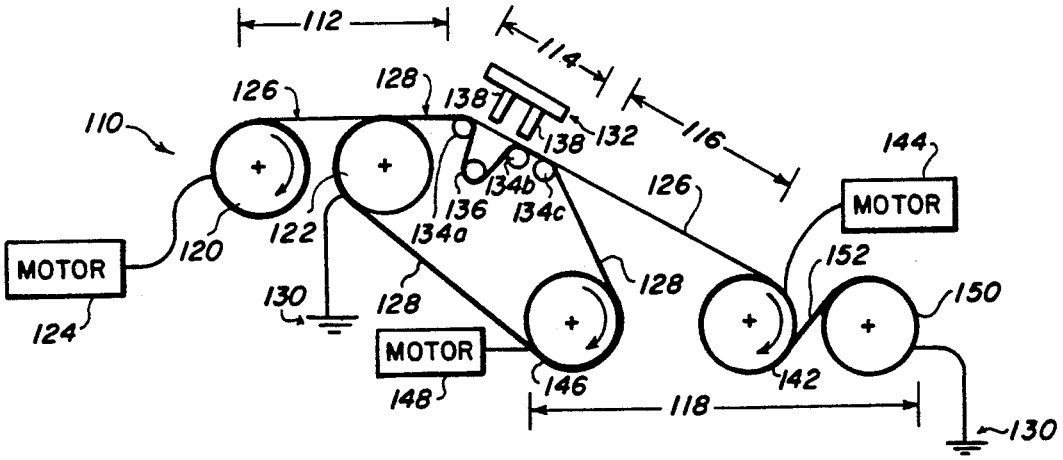
FIG. 2 is a schematic side elevational view of an alternative embodiment of the apparatus of FIG. 1.

For long fiber spools, the tension may drift out of the controllable range of adjustment rollers 36 and 40. In such a case, modifications in the embodiment of FIG. 1, shown in FIG. 2. The embodiment of FIG. 2 is very similar to that of FIG. 1, and like elements have been given the reference numerals in FIG. 2, plus 100. The major difference in the embodiment of FIG. 2 is in the collection region 118. To provide better control of the tension, an additional spool 146 is provided to receive foil 128. Spool 146 is driven by a motor 148 which causes spool 146 to rotate at the same speed as spool 120. An additional spool 150 is provided to dispense a foil 152 which is very similar to foil 128. Sheet 152 is grounded electrically by connecting the sheet 152 to ground at 130. Spool 142 functions slightly differently than its counterpart spool 142 of FIG. 1. In the embodiment of FIG. 2, spool 142 receives fiber tow 126 and foil 152. The fiber tow 126 is electrostatically attracted to sheet 152 in a similar fashion to foil 128. By providing a separate receiving spool 146 for foil 128, the tension on foil 128 may be maintained within a controllable range, i.e., a range in which adjustment roller 136 can control the tension. Although FIG. 2 shows foil 128 as a continuous loop between spools 122 and 146, although foil 128 can extend between the over the upper surface of spools 122 and 146 without a return loop. When there is no return loop, spool 122 acts as a foil supply spool and spool 146 acts as a foil take-up spool.

The electrostatic fiber spreader of the invention causes a minimal amount of fiber breakage because the fibers are charged by corona discharge while transporting the fibers on a grounded foil or sheet 28 or 128. By spreading the fibers as described above, a higher quality fiber composite is produced because of the reduced fiber breakage. Furthermore, as to controllability and automatization, a grounded sheet transport is better suited to existing manufacturing processes than conventional pneumatic transports.

Although the present invention has been described relative to specific exemplary embodiments thereof, it will be understood by those skilled in the art that variations and modifications can be effected in these exemplary embodiments without departing from the scope and spirit of the invention. An example of such a modification concerns the use of apparatus of the invention in providing spreading of conductive fibers; rather than the non-conductive fibers described above; by first coating the conductive fiber with an insulative layer, the apparatus of the invention can be used to uniformly spread conductive fibers.

What is claimed is:

1. An apparatus for uniformly spreading fibers, said apparatus comprising:

a support sheet;

a fiber tow including a layer of fibers;

at least one corona discharge means positioned adjacent to a region of said support sheet for providing substantially uniform spreading of said layer of fibers; and means for providing movement of said sheet and said fiber tow past said corona discharge means, said tow being supported upon regions of said support sheet upstream and downstream of said corona discharge means and separated from said region of said support sheet adjacent to said at least one corona discharge means.

2. The apparatus recited in claim 1 further comprising a plurality of guide rollers for guiding the movement of said support sheet, said guide rollers being positioned so as to provide at least one region in which said support sheet and said fiber tow are physically separated.

3. The apparatus recited in claim 1 further comprising tension adjusting means for adjusting tension on said fiber tow.

4. The apparatus recited in claim 3 wherein said tension adjusting means comprises a guide roller around which said support sheet passes so as to separate from said fiber tow and means for varying the spacing between said guide roller and the position of said fiber tow separated from said support sheet.

5. The apparatus recited in claim 1 wherein said support sheet comprises an electrically conductive foil.

6. The apparatus recited in claim 1 wherein said support sheet comprises a metallic foil.

7. The apparatus recited in claim 1 wherein said support sheet is electrically grounded.

8. The apparatus recited in claim 5 wherein said movement providing means comprises a spool for receiving said support sheet and a motor for rotating said spool to cause said sheet to be wound on said spool.

9. The apparatus recited in claim 1 wherein said fibers comprise electrically nonconductive fibers.

10. The apparatus recited in claim 1 further comprising a spool on which said fiber tow is initially wound, a storage spool on which said support sheet is wound, and a collection spool on which said fiber tow and said support sheet are wound after said fiber tow moves past said corona discharge device.

11. The apparatus recited in claim 1 further comprising a fiber supply spool on which said fiber tow is initially wound, a support sheet supply spool on which said support sheet is initially wound, a collection spool on which said support sheet is wound after said fiber layer passes said corona discharge device; a further support spool for a further support sheet; and a further collection spool for said fiber tow and said further support sheet.

12. An apparatus for uniformly spreading fibers, said apparatus comprising:

an electrically grounded support sheet;

a fiber tow including a plurality of fibers supported in a layer on regions of one surface of said support sheet;

at least one corona discharge device, positioned adjacent to a first region of said support sheet, for providing substantially uniform spreading of said plurality of fibers;

means for advancing said support sheet past said corona discharge device, said advancing means comprising a spool for receiving said support sheet and a motor for causing rotation of said spool;

a plurality of guide rollers for guiding movement of said support sheet, so that said support sheet and said fiber tow are physically separated from each other along said first region, brought together, downstream from said first region, along a second region of said support sheet, and again physically separated from said support sheet along a third region of said support sheet downstream from said second region.

13. The apparatus recited in claim 12 further comprising tension adjusting means for adjusting tension on said fiber tow.

14. The apparatus recited in claim 13 wherein said tension adjusting means comprises a guide roller around which said support sheet passes so as to separate from said fiber tow and means for varying the spacing between said roller and the position of said fiber tow separated from said support sheet.

15. The apparatus recited in claim 12 wherein said support sheet comprises a metallic foil.

16. The apparatus recited in claim 12 wherein said movement providing means comprises a spool for receiving said support sheet and a motor for rotating said spool to cause said sheet to be wound on said spool.

17. The apparatus recited in claim 12 further comprising a spool on which said fiber tow is initially wound, a storage spool on which said support sheet is wound, and a collection spool on which said fiber tow and said support sheet are wound after said fiber tow moves past said corona discharge device.

18. The apparatus recited in claim 12 further comprising a fiber supply spool on which said fiber tow is initially wound, a support sheet supply spool on which said support sheet is initially wound, a collection spool on which said support sheet is wound after said fiber tow passes said corona discharge device; a further support spool for a further support sheet; and a further collection spool for said fiber tow and said further support sheet.

19. A method for uniformly spreading fibers, comprising the steps of:

providing at least one corona discharge means;

supporting a fiber tow, including a layer of fibers, on first and second regions of one surface of a support sheet;

moving said sheet and said fiber tow past at least one corona discharge means positioned adjacent to a third region of said sheet, between said first and second regions, while separating said fiber tow from said sheet at said region of said sheet passing through said corona discharge means and separating said fiber tow from said sheet along a fourth region of said sheet downstream from said second region.

20. The method of claim 19, wherein said sheet is electrically conductive and said fiber tow is electrically nonconductive.

* * * * *